US007475780B2

(12) United States Patent
Hinze et al.

(10) Patent No.: US 7,475,780 B2
(45) Date of Patent: Jan. 13, 2009

(54) RECLOSABLE FOOD PACKAGE HAVING AN EASY-OPEN FEATURE

(75) Inventors: Bonita M. Hinze, Sun Prairie, WI (US); Chad M. Evenson, Battle Creek, MI (US)

(73) Assignee: Kraft Foods Global Brands LLC, Northfield, IL (US)

( * ) Notice: Subject to any disclaimer, the term of this patent is extended or adjusted under 35 U.S.C. 154(b) by 6 days.

(21) Appl. No.: 11/362,441

(22) Filed: Feb. 24, 2006

(65) Prior Publication Data

US 2007/0202221 A1 Aug. 30, 2007

(51) Int. Cl.
*B65D 73/00* (2006.01)
*B65B 25/06* (2006.01)

(52) U.S. Cl. ..... 206/469; 53/452; 220/359.2; 426/106; 426/129

(58) Field of Classification Search ..... 206/461, 206/462, 464, 465, 469, 471, 518; 220/359.1–359.4; 426/106, 115, 123, 129, 392, 396; 53/452, 53/467, 473
See application file for complete search history.

(56) References Cited

U.S. PATENT DOCUMENTS 3,782,586 A * 1/1974 Brown ..... 220/270
4,498,589 A * 2/1985 Scott et al. ..... 426/106
4,531,668 A 7/1985 Forbes, Jr.
4,944,409 A 7/1990 Busche et al.
4,955,530 A 9/1990 Rigby et al.
4,964,515 A 10/1990 Heyden
5,042,681 A 8/1991 Bolte et al.
5,082,112 A * 1/1992 Dunklee ..... 206/471
5,116,651 A 5/1992 Katsura et al.
5,118,002 A * 6/1992 Sugiyama et al. ..... 220/359.3
5,129,517 A * 7/1992 Hustad ..... 206/467
5,293,997 A * 3/1994 Hustad et al. ..... 206/467
5,353,943 A 10/1994 Hayward
5,366,295 A 11/1994 Montesissa et al.
5,421,512 A 6/1995 Poole
5,512,337 A 4/1996 Littmann et al.
5,520,939 A * 5/1996 Wells ..... 426/129
5,655,661 A 8/1997 Rigby
5,688,544 A 11/1997 Bolton et al.
5,692,635 A 12/1997 Farrell et al.
5,804,237 A 9/1998 Diamond
5,874,155 A 2/1999 Gehrke et al.
5,878,549 A 3/1999 Littmann et al.
5,882,789 A 3/1999 Jones et al.

(Continued)

*Primary Examiner*—Luan K Bui
(74) *Attorney, Agent, or Firm*—Fitch, Even, Tabin & Flannery

(57) ABSTRACT

The food package includes a base with a food storage compartment and a lid selectively mateable with the base for closing the compartment. The periphery of the base has a flange that abuts a corresponding flange of the lid when the lid is mated to the base to close the compartment. Prior to initially opening the food package, the flanges of the base and lid are sealed together at a sealing area surrounding the food compartment to seal the food compartment. The flanges of both the base and lid have an outwardly extending tab portion that at least partially overlap with each other. An easy-open feature, located on one of the overlapping tab portions, is sized and positioned to space the adjacent tabs apart in order to facilitate pulling apart the flanges to separate the lid from the base to gain access to the food product in the food compartment of the base.

21 Claims, 4 Drawing Sheets

U.S. PATENT DOCUMENTS

| | | | | |
|---|---|---|---|---|
| 5,904,263 | A | 5/1999 | St. Pierre et al. | |
| 5,992,674 | A | 11/1999 | Schulz | |
| RE37,171 | E | 5/2001 | Busche et al. | |
| 6,248,442 | B1 | 6/2001 | Kong et al. | |
| 6,358,622 | B1 | 3/2002 | Shida et al. | |
| 6,648,140 | B2 * | 11/2003 | Petricca | 220/359.2 |
| 6,843,042 | B2 | 1/2005 | Nakabayashi et al. | |
| 7,172,779 | B2 * | 2/2007 | Castellanos et al. | 426/106 |
| 2004/0062838 | A1 | 4/2004 | Castellanos et al. | |
| 2004/0202750 | A1 | 10/2004 | Versluys | |
| 2005/0233036 | A1 | 10/2005 | Feldmeier et al. | |

* cited by examiner

RECLOSABLE FOOD PACKAGE HAVING AN EASY-OPEN FEATURE

FIELD

This disclosure relates generally to packaging for a food product, and more particularly to reclosable food packaging with an easy-open feature.

BACKGROUND

Sliced meat, cheese, and other food products are often stored in packaging prior to consumption. Food products are often enclosed in sealed, rigid packaging. The packaging may be reclosable depending on the quantity of food product. The same package that stores the food product can also be difficult for a consumer to open. For example, one type of rigid package includes a base with a food storage compartment and a lid for closing the compartment. The periphery of the base has a flange that abuts a corresponding flange of the lid when the compartment is closed. Such packages may have a small, localized projection on one of the flanges creating localized separation between the flanges of the base and lid so that a consumer can open the packaging by pulling the flanges apart, adjacent the localized separation.

In U.S. Pat. No. 5,904,263, a small dimple is disclosed that facilitates separation of peel tabs created of a co-extruded Nylon/Surlyn material. A similar feature is described in U.S. Patent Publication No. 2004/0062838, which discloses corresponding bumps positioned on adjacent packaging tabs such that the raised centers of the projections abut one another.

The food packages can be formed from two webs: a web of base members and a web of lid members. The two members can be joined at sealing portions of the flanges by thermo-bonding when the flanges are heated to a point that melts the sealing portions of the flanges together, or they may be joined by using glue or adhesive, which may also be heated. After the package has been filled with the food product, the two members aligned with one another, and the base and lid glued or bonded together, the packages are then separated from the webs, such as with a cutting tool. This separation process may result in tacking of the edges of the flanges, outside of the sealing portion of the flange that is meant to bond together. If this tacking occurs where a consumer is to initiate pulling the adjacent surfaces apart, a consumer may experience difficulty in pulling apart the flanges to separate the lid from the base to gain access to the food product in the compartment of the base.

SUMMARY

Reclosable packaging for a food product is disclosed where the package includes a base with a food compartment and a lid for closing the food compartment. The base and lid have overlapping portions that are initially sealed together, such as with a hermetic seal, at a sealing area extending around the food compartment. One of the overlapping portions of the base and lid, on an opposite side of the sealing area from the food compartment, has an easy-open feature including a protuberance abutting against the other of the overlapping portions of the base and lid to maintain a localized gap or spacing between the overlapping portions in order to facilitate initial separation of the base and lid to gain access to the food product in the food compartment. Once the initial seal has been ruptured, the lid and base are configured to permit reclosing of the food compartment. The lid and base may be configured to facilitate nesting, such as by having different draft angles on sidewalls of the lid and sidewalls of the base.

The location and size of the protuberance are selected such that the protuberance does not cause premature rupturing of the initial seal of the sealing area between the overlapping portions of the base and lid while still providing the localized spacing. The protuberance is preferably sized to create localized space between the overlapping tab portions and thereby prevents the adjacent edges of the base and lid from tacking in that area during the manufacturing process. The length of the protuberance is such that a sufficient span of the localized gap can be achieved, such as having a length greater that its width where the length is generally aligned with the adjacent edges of the overlapping portions. To encourage separation, the protuberance is generally located closer to the edge of overlapping portions of the lid and base than to the sealing area, such that some space is created between the edges. Positioning the localized space closer to the edges than to the sealing area, such as at about a half of the distance from the edge to the sealing area, can facilitate separation of the overlapping portions of the base and lid and thus opening of the food package to gain access to any food product disposed in the food compartment of the base.

A method of packaging a food product in the reclosable package is also disclosed, where the method includes forming the base in a first sheet of material, forming a lid for covering the food compartment of the base in a second sheet of material, and forming a protuberance disposed on a portion of one of the base and lid that will overlap when the base and lid are mated together. The protuberance may have a length and a width where the length is substantially greater than the width, and the protuberance may be located near an edge of the one of the base and lid, and the distance from the protuberance to the closest edge may be less than half of the distance from the protuberance to a sealing area between the base and lid. The method may further include inserting a food product into a food compartment of the base, positioning the first sheet having the base formed therein and the second sheet having the lid formed therein adjacent each other such that the lid closes the food compartment of the base, sealing the lid and the base together at the sealing area, and cutting the lid and the base together from the first sheet and the second sheet after sealing to singulate the reclosable package from the first sheet and the second sheet. The method may further include thermoforming the base, lid and protuberance, and the first and second sheets may be an amorphous polyester.

DETAILED DESCRIPTION OF THE DRAWINGS

Various embodiments of an easy-open feature for a food package are illustrated in FIGS. 1-12. The food package includes a base with a food storage compartment and a lid selectively mateable with the base for closing the compartment. The periphery of the base has a flange that abuts a corresponding flange of the lid when the lid is mated to the base to close the compartment. Prior to initially opening the food package, the flanges of the base and lid are sealed together at a sealing area surrounding the food compartment to seal the food compartment. The flanges of both the base and lid have an outwardly extending tab portion that at least partially overlap with each other. The easy-open feature, located on one of the overlapping tab portions, is sized and positioned to space the adjacent tabs apart in order to facilitate pulling apart the flanges to separate the lid from the base to gain access to the food product in the food compartment of the base, even when the package material and manufacturing process is such that the flange and/or tab edges may tend to tack. The easy-open feature may be a protuberance that occupies sufficient surface area to create a localized gap between the adjacent tab surfaces to space the adjacent tabs apart, and the protuberance may be located proximate the tab edge to maximize separation between the tab edges of the base and the lid without interfering with the seal between the lid and the base, such as about half of the distance or greater from the seal to the edge of the tab.

Figure 1:
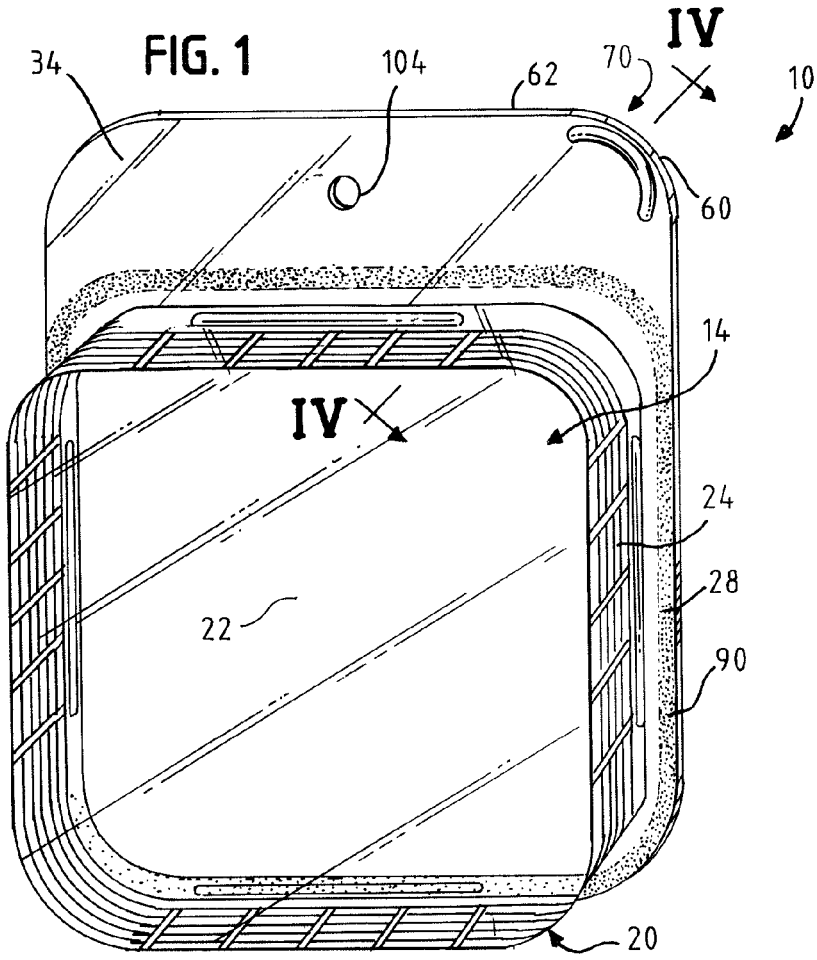
FIG. 1 is a perspective view illustrating an embodiment of a food package having an easy-open feature between flanges of a base and a lid located on a tab portion.
Figure 2:
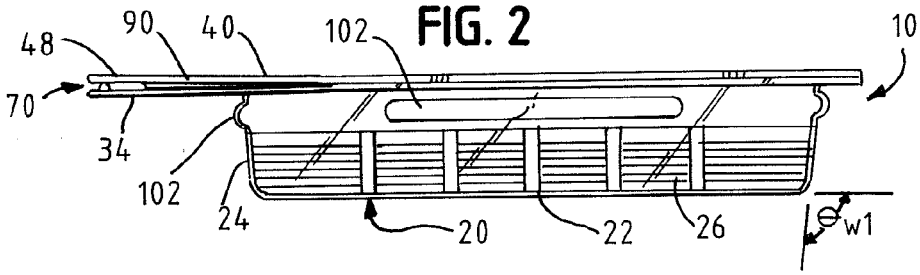
FIG. 2 is a side elevational view of the food package of FIG. 1.

A food package 10 for containing a food product 12 prior to consumption by a consumer is illustrated in FIGS. 1-12. The food package 10 includes a base 20 and a removable lid 40, as illustrated in FIG. 2. A portion of base 20 defines a food compartment 14 to contain the food product 12. The food product 12 is disposed in the food compartment 14, which is then selectively closed by attaching the lid 40 to the base 20.

The food compartment 14 of the base 20 includes a generally planar bottom wall 22 having an upstanding sidewall 24 around its periphery. The bottom wall 22 and sidewall 24 may generally correspond to the shape of the food product 14. Such a configuration of the bottom wall 22 and sidewall 24 can confine the food product 12 within the compartment 14 to minimize shifting and movement of the food product 12, such as during shipping and stocking. The sidewall 24 may have a plurality of ridge sections 26 that can add strength to the food compartment 14 of the base 20. Although the food compartment 14 illustrated herein has a generally square shape with rounded corners, the food compartment could also have a circular, ovular, rectangular, or other shape. A flange 28 is attached to the sidewall 24 of the compartment 14 on an edge of the sidewall 24 opposite the bottom wall 22 and extends outwardly therefrom. The flange 28 is generally planar and extends continuously around the entire food compartment 14 of the base 20. A portion of the base flange 28 also includes an outwardly extending tab 34. The base tab 34 extends outward from the flange 28 on one side or portion of the package 10, and may not extend the entire length of that side of the package 10.

The flange 28 is generally parallel to the bottom wall 22. The sidewall 24 is generally perpendicular to both the bottom wall 22 and the flange 28. The base flange 28 and lid flange 46 are both planar and generally parallel one another when the base 20 and lid 40 are mated together. This allows the two flanges 28, 46 to bond together easily when they are either thermobonded or glued together.

The lid 40 includes a food compartment closure 16 having a generally flat bottom wall 42 with an upstanding sidewall 44 around its periphery. The bottom wall 42 and sidewall 44 may generally correspond to the shape of the food product 14 stored in the compartment 14. A flange 46 is attached to the sidewall 44 of the lid 40 on an edge of the sidewall 44 opposite the bottom wall 42 and extends outwardly therefrom. The lid flange 46, like the base flange 28, is generally planar and extends continuously around the entire food compartment closure 16 of the lid 40. A portion of the lid flange 46 also includes an outwardly extending tab 48. The lid tab 48 extends outward from the flange 46 on one side or portion of the package 10, and may not extend the entire length of that side of the package 10. The lid bottom wall 42 is recessed from the flange 46. The flange 46 is generally parallel to the bottom wall 42. The bottom wall 42 and the flange 46 extend outward from the sidewall 44 in opposite directions. The lid sidewall 44 is generally perpendicular to both the lid flange 46 and the bottom wall 42.

The lid bottom wall 42 and sidewall 44 also may generally correspond to the base bottom wall 22 and sidewall 24 such that the base 20 and the lid 40 may be mated together. That is, the food compartment closure 16 of the lid 40 may be configured to fit partially into the food compartment 14 of the base 20 such that the sidewall 24 of the base 20 and the sidewall 44 of the lid 40 are in engagement with each other to close the food compartment 14, as will be discussed in greater detail below.

The food package 10 has a seal area 90 that is disposed upon a portion of the generally planar flanges 28 and 46 where a seal is formed between the flanges 28 and 46 of the lid 40 and the base 20. An adhesive may be used to seal together the base 20 and the lid 40, or the seal could be portions of the two flanges 28 and 46 that are heated to melt them together. The food packaging material may affect how the seal is to be formed. The seal area 90 surrounds the food compartment 14 of the base 20 and the food compartment closure 16 of the lid 14 such that when the base 20 is mated with the lid 40, as shown in FIGS. 1 and 2, the seal of the seal area 90 adheres the base flange 28 together with the lid flange 46 to close the food compartment 14, preferably but not necessarily with a hermitic seal.

The force required to reopen the food compartment 14 after the initial seal of the sealing area 90 has been broken is preferably less than that force required to initially open the food compartment 14 by breaking the seal of the sealing area 90. For example, the embodiment of the food package 10 illustrated in FIG. 1 may require an opening force of about 5.5 to 8.9 lbs in order to initially rupture the seal of the sealing area 90, such as by gripping each of the flanges or tabs and pulling apart. Thus, the force required to reopen the food compartment 14 in this specific embodiment is preferably less than the force required to initially rupture the seal of the sealing area 90.

As mentioned above, the flange 28 of the base 20 and the flange 46 of the lid 40 each include tab portions 34, 48 that extend from the flanges 28, 46 and sidewalls 24, 44. While the flanges 28, 46 surround the food package 10 extending, along all four sides of the food package 10 of the embodiment illustrated in FIGS. 1-5, the tabs 34, 48 may extend from the flanges 28, 46 on only one side of the package 10. The base tab 34 and lid tab 48 at least partially overlap one another when the lid 40 and the base 20 are mated together. One or both of the tabs 34, 48 can be sized to accommodate a product label, and an aperture 104 that can be used to hang the food packaging 10 for display may be made through one or both of the tabs 34, 48.

Figure 3:
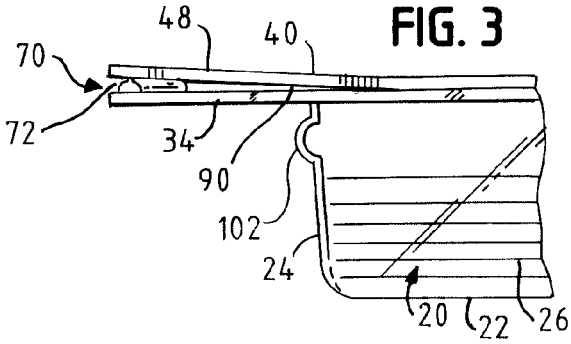
FIG. 3 is an enlarged portion of a side elevational view of the food package of FIG. 1 showing the easy-open feature.

One of the base tab 34 and the lid tab 48 includes an easy-open feature in the form of a protuberance 70 located on an overlapping portion of the tabs 34, 48. The protuberance 70 is sized and positioned to space the adjacent tabs 34, 48 apart in order to facilitate pulling apart the flanges 28, 46 to separate the lid 40 from the base 20 to gain access to the food product 12 in the food compartment 14 of the base 20. When the lid 40 and the base 20 are mated together, the highest point on the protuberance 70 contacts the overlapping tab, but the portion of the tab having the protuberance and adjacent to the protuberance, which is not raised, does not contact the overlapping tab, thus creating a localized space 72 between the two tabs 34, 48. As illustrated in FIGS. 2 and 3, the protuberance 70 is located on the tab 34 of the base 20. It is understood, however, that the protuberance 70 could instead be located on the tab 48 of the lid 40.

The protuberance 70 is located near an edge 60 of the tab 34 of the base 20 to facilitate separating the two overlapping tabs 34, 48, and in particular to facilitate separation of the two overlapping tabs 34, 48, and thus the flanges 28, 46 as well, when the flanges 28, 46 are initially sealed together at the sealing area 90. The protuberance 70 is preferably, though not necessarily, located adjacent a corner 62 to permit ready identification of the portion of the overlapping tabs 34, 48 having the localized spacing. The protuberance 70 is located a sufficient distance from the seal 90 and has a height selected to ensure that the protuberance 70 does not interfere with the seal of the sealing area 90. For example, it is undesirable for the protuberance 70 to have a height and a location such that the protuberance 70 could cause the seal of the sealing area 90 to unintentionally rupture, such as during shipping and handling of the food package 10.

Figure 7:
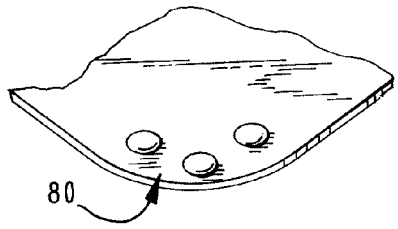
FIG. 7 is a top plan view of a portion of the tab having an alternative easy-open feature.

One embodiment of the protuberance 70, comprising an arc located near a corner 62 of the tab 34 of the base 20, is illustrated in FIGS. 1-6. The shape of the arc broadly corresponds to the shape of the corner 62, as illustrated in detail in FIG. 6. The protuberance 70 has a length (L), measured from one tip to the other along a longitudinal axis of the protuberance 70; a width (W), measured transversely between longitudinal sides of the protuberance 70; and a height (H), measured from intersection of the protuberance 70 with the base tab 34 to the center of the raised protuberance 70. The protuberance is located a specified distance from the edge 60. In another embodiment, the protuberance 80 can comprise three raised bumps or dots, as shown in FIG. 7. The protuberance 80 also has a length, which would be measured as the distance from a beginning dot to an end dot and including any intermediate dots; width; and height. Other shapes of the protuberance also may be used, such as a single linear protuberance or a protuberance of intersecting or spaced linear elements.

Figure 4:
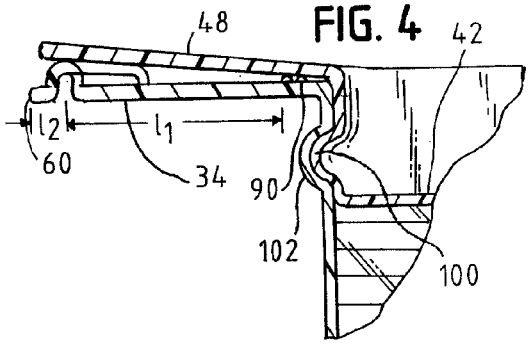
FIG. 4 is a cross-sectional view of a portion of the food package of FIG. 1 taken along line IV-IV of FIG. 1 and showing the easy-open feature.

As shown in FIGS. 3 and 4, the location of the protuberance 70 provides a localized gap or spacing between the base tab 34 and lid tab 48. This spacing facilitates the pulling apart of the base tab 34 and the lid tab 48 to initially break the seal of the sealing area 90 to permit separation of the lid 40 from the base 20 to gain access to the food compartment 14 of the base 20 and any food product 12 disposed therein. The spacing is selected to be large enough to be sufficient to prevent edges of the tabs 34, 48 from bonding to one another, such as during manufacturing, while at the same time to be not so large as to permit inadvertent opening of the seal of the sealing area 90.

After the food product 12 is inserted in the packaging, the base 20 and lid 40 are mated together, and the package is evacuated, the base and lid are separated from one another, as discussed in greater detail in one example below of a method of packaging the food product 12. During this process, the adjacent edges of the flanges 28, 46 and tabs 34, 48 may have a tendency to tack or fuse together, depending upon the type of material and the manufacturing process. This can be problematic for the consumer because while the flanges have a seal that bonds or fuses together, a portion of the edges of the tabs 34, 48 should remain unbonded to facilitate initial opening of the food package 10. By placing the protuberance 70 near the edge 60 of the tabs 34, 48, the adjacent surfaces do not tack together because of the localized gap.

In one embodiment of the food package 10 suitable for hanging on a peg, the heights of the base 20 and lid 40 may be between about 4.5 to 6.5 inches, and are preferably about 6 inches. The widths of the base 20 and lid 40 may be between about 4.0 to 6.0 inches, and preferably about 5 inches. The sidewall 24 of the base 20 has a depth of between about 0.8 to 1.2 inches, and preferably about 1.1 inches. The sidewall 44 of the lid 40 has a depth of between about 0.25 to 0.45 inches, and preferably about 0.3 inches. The sealing area 90 may be about 0.2 inches in width, and the base tab 34 and the lid tab 46 may project outwardly from the sealing area 90 between about 0.8 and 1.2 inches, and preferably about 1 inch.

The length (L), height (H) and the width (W) of the protuberance 70, and the location of the protuberance 70 on the tab 34 on the base 34, are selected such that a sufficient span of the localized gap is created, while the width is not so large as to inadvertently cause the seal of the sealing area 90 to inadvertently rupture, such as by exceeding the bond strength in the sealing area 90. In the illustrated embodiment of FIGS. 1-6, the protuberance 70 may have a height (H) of approximately 0.039 inches. The protuberance 70, located on the base 20, is an arc spanning approximately 90° and may have a radius of curvature of approximately 0.44 inches, and therefore a length (L) of about 0.69 inches. The radius of curvature of the corner 62 of the tab edge 62 may be approximately 0.500 inches. The width (W) of the protuberance 70 may be between about 0.05 inches and 0.2 inches, and preferably is approximately 0.1 inches. Thus, the ratio of the length (L) to the width (W) of the protuberance 70 is greater than both 4:1 and 6:1, and the ratio of the height (H) to the width (W) is at least 1:4, and can be about 2:5. The distance ($I_1$) from the sealing area 90 to closest part of the center of width (W) the protuberance 70 for the protuberance 70 having the above dimensions is at least twice the distance ($I_2$) from the edge 60 of the corner 62 adjacent the protuberance 70 to the closest part of the center of the width of the protuberance 70. In the illustrated example, $I_1$ is about 0.60 inches and $I_2$ is less than about 0.1 inches.

In another embodiment (not illustrated), a food package may be provided having a food compartment with increased storage capacity. The food package may have a height of about 5.65 inches, a width of about 5.00 inches, and the sidewall of the base may have a depth of about 1.8 inches. The tabs of the base and lid may not extend the entire length of one of the sides of the food package. For example, if the package is not to be pegable then the tabs need not extend to the center of one of the sides. The easy-open feature, such as the protuberance 70, can be incorporated into other package configurations, such as disclosed in U.S. patent application Ser. No. 11/258,605, the disclosure of which is hereby incorporated by reference.

The sidewall 24 and the bottom wall 22 may form a slightly obtuse angle, depicted as $\theta_{W1}$ in FIG. 2. In one example, the angle $\theta_{W1}$ may be between about 93° and 96°. A slightly obtuse angle between the bottom wall 22 and sidewall 24 can allow for nesting of the base 20 with other like base members, can provide clearance to position the product inside the food compartment 14, and can provide draft to permit removal of the compartment 14 from a forming cavity during manufacturing of the base 20, as will be discussed in greater detail below. To ensure a generally secure fit when the base 20 and the lid 40 are mated together, the sidewall 44 and bottom wall 42 may form a slightly obtuse angle that corresponds to the angle between the base bottom wall 22 and sidewall 24.

Figure 5:
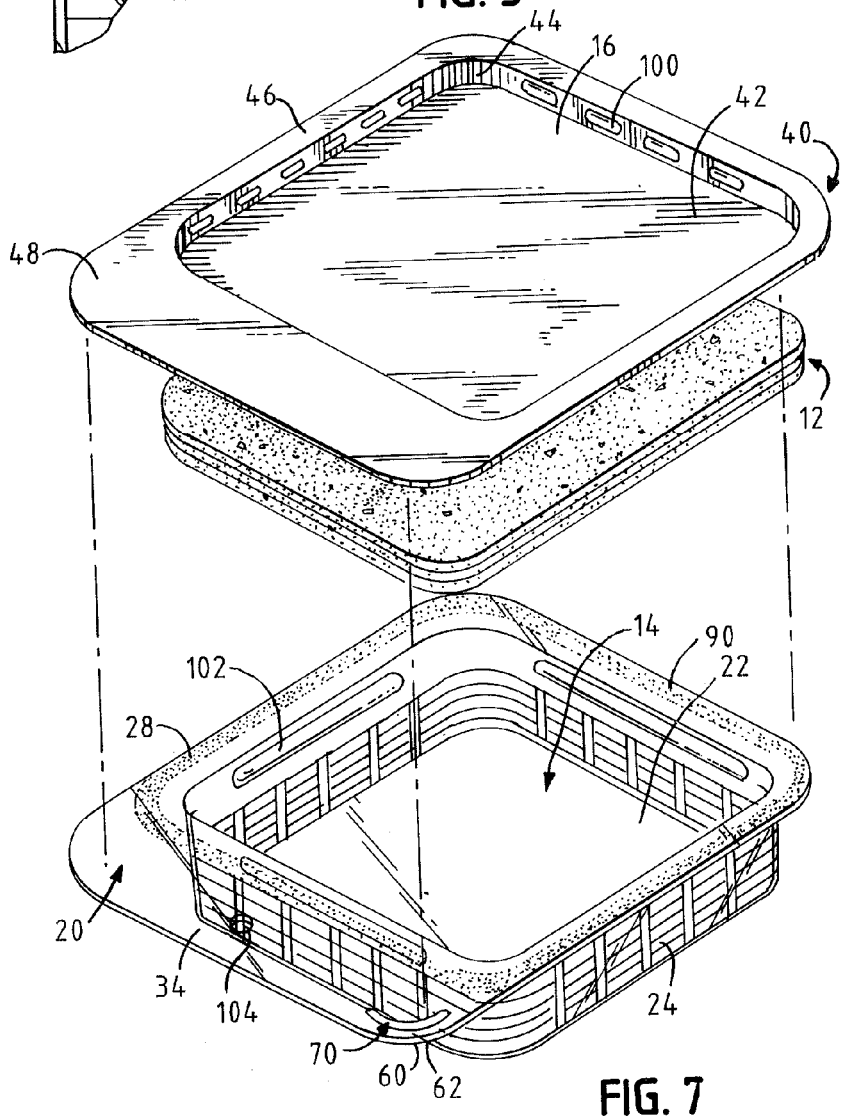
FIG. 5 is an exploded perspective view of the food package of FIG. 1 showing the lid, base, and a food product.
Figure 6:
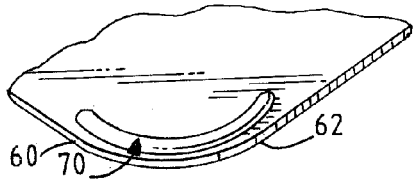
FIG. 6 is a top plan view of a portion of the tab of FIG. 1 having the easy-open feature.

Turning now to more of the details of the mating of the base 20 and the lid 40, the base 20 and the lid 40 may include engagement portions to selectively mate the base 20 and lid 40 together. Corresponding lugs 100 and recesses 102 may be used to mate together the base 20 and lid 40. The base sidewall 24 may include a plurality of the recessed portions 102 proximate an edge of the sidewall 24 that is adjacent to the flange 28. The recess portions 102 may be concave channels that are configured to mate with a plurality of lugs 100 located on the lid sidewall 44, as illustrated in FIG. 4. As shown in FIG. 5, several lugs 100 of a side of the sidewall 44 of the lid 40 are designed to fit within one recess 102 on a side of the sidewall 24 of the base 20. The lugs 100 and recesses 102 are configured to require an opening force to separate the lid 40 from the base 20, and thus to remove the food compartment closure 16 from the food compartment 14 to gain access to the food compartment 14 and any food product 12 therein. The lugs 100 and recesses 102 are also configured to permit the food compartment closure 16 of the lid 40 to be reinserted into the food compartment 14 to reclose the food compartment 14. The lugs 100 and recesses 102 may be formed simultaneously, as disclosed in U.S. patent application Ser. No. 11/258,605.

The food package 10 may be at least partially transparent such that the food product 12 is visible without opening the food package 10 and breaking the seal of the sealing area 90. The base 20 and the lid 40 can be independently made from a variety of materials including homogenous plastic films, plastic films provided with heat sealable coatings, multi-layered film laminates, and/or co-extruded films, and the like. In one embodiment, packaging material for the base and lid may include a multi-layered plastic film construction suitable for packaging of refrigerated meat products including at least a thin, intermediate layer which is substantially impervious to oxygen, in combination with an outer structural layer having sufficient structural characteristics so that the laminate is sufficiently rigid for shape retention during handling, and usage of integral snap-fit closure features included with the package.

More specifically, the multi-layered film of the base and lid may include an outer structural layer that is a relatively rigid plastic material that will substantially retain a shape that is thermoformed therein. Non-limiting examples of the outer structural layer for the base include amorphous polyester (e.g., amorphous polyethylene terephthalate (APET)), a high impact polystyrene (HIPS), polystyrene, polyester (e.g. colored polyester terephthalate), high density polyethylene (HDPE), polypropylene polyester copolymers such as polyethylene terephthalate glycol (e.g., Vivak®), styrene-butadiene copolymers (e.g., K-resin®), or acrylonitrile (e.g., Barex®). Non-limiting examples of the outer structural layer for the lid include amorphous polyester (e.g., amorphous polyethylene terephthalate (APET)), polypropylene, polystyrene, polyester copolymers such as polyethylene terephthalate glycol (e.g., Vivak®), styrene-butadiene copolymers (e.g., K-resin®), or acrylonitrile (e.g., Barex®). Another possible material for both the base 20 and lid 40 is PVC (Poly Vinyl Chloride).

One possible material for the base 20 is a layer scheme including 17.0 mils of APET-EVOH-APET co-extruded, a primer, and 2 mils of EVA Ez Peel™ Sealant. A possible material for the lid 40 is a layer scheme including a slip coat, 8.5 mils yellow APET, a primer, and 2 mils EVOH EVA sealant. Another possible scheme of layers of a multi-layer film used to construct the base is: an outer structural layer, EVA, tie resin, EVOH barrier, tie resin, and multi-film sealant layer. The base may be a multi-layer film having a thickness of about 10 to about 25 mils, and particularly about 12 to about 18 mils. Another possible scheme of layers of a transparent multi-layer film useful to construct the lid is: an outer structural layer, primer, ethyl vinyl acetate copolymer (EVA) layer, tie resin, ethylene vinyl alcohol (EVOH) copolymer barrier layer, tie resin, sealant layer(s). The lid may be a multi-layer film having a thickness of about 5 to about 20 mils, and particularly about 8 to about 12 mils.

Figure 8:
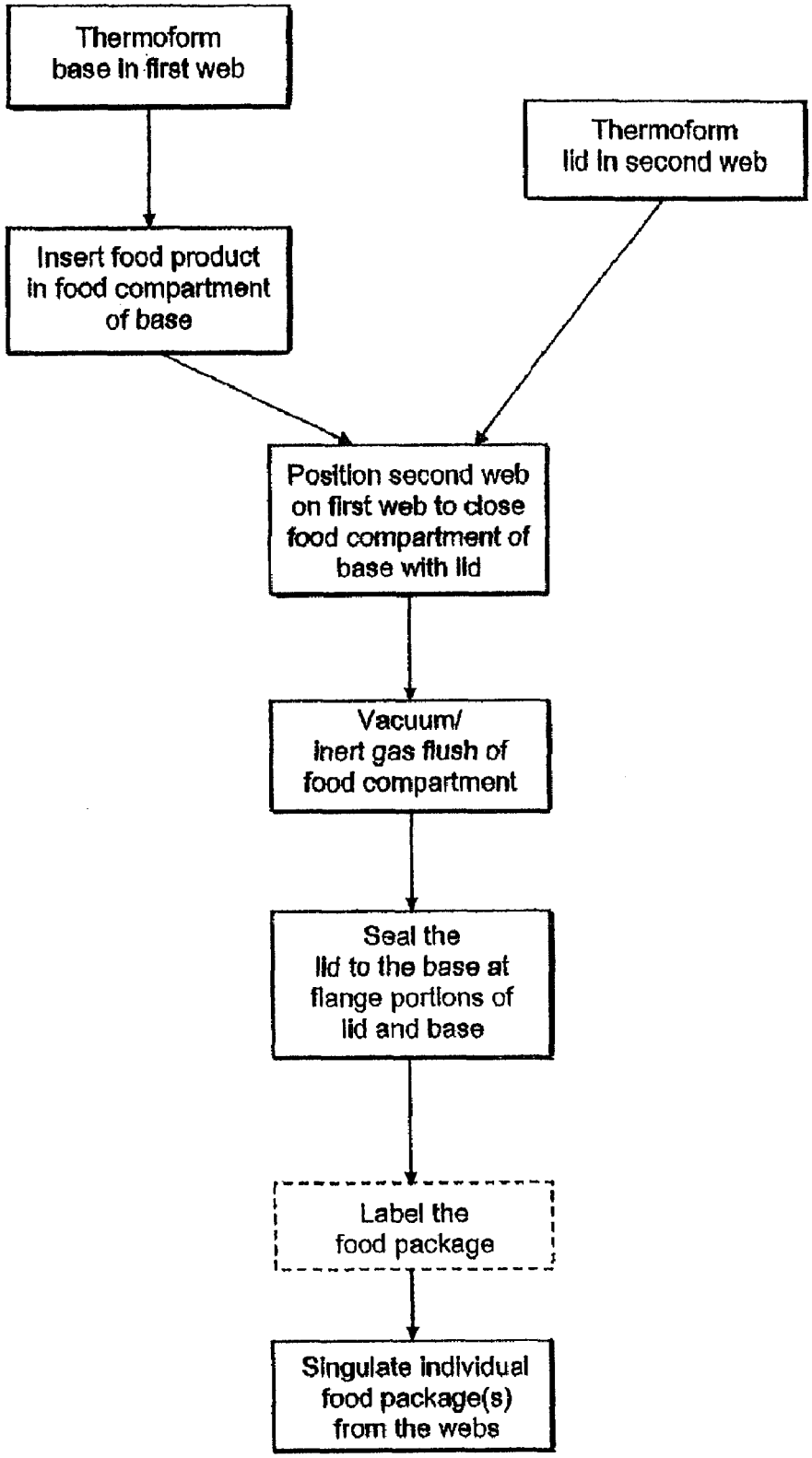
FIG. 8 is a flow chart of a method for manufacturing the food package of FIG. 1.

An example of steps suitable for forming the food packages 10 disclosed herein is illustrated in FIG. 8. The base and lid may be separately manufactured from respective thermoformable multi-layered webs, which may be supplied as roll stock and run on a form-fill-seal machine, or the like. The web for the base 20 is thermoformed to shape the food compartment 14 of the base 20 in the web, and the web for the lid 40 is thermoformed to shape food compartment closure 16 of the lid 20 in the separate web. Multiple arrays of bases 20 and lids 40 may be formed in the respective webs. However, each package could also be individually made, instead of formed in the larger web arrays. After forming the food compartment 14 of the base 20 in the web for the base 20, food product 12 is inserted into the food compartment 14. Next, the formed web for the lid 40 is positioned adjacent the formed web for the base 20 such that the food compartment closure 16 of the lid 40 is inserted into the food compartment 14 of the base 20 to close the food compartment 14. The food compartment 14 may optionally be gas flushed or a vacuum applied to the food compartment 14 prior to sealing of the flanges 28, 46 of the base 20 and lid 40 portions of the webs together at the sealing area 90. The sealed, filled food packages 10 are then singulated from the web of the lid 40 and the web of the base 20 generally at the same time and using the same cutting tool or blade. A label may optionally be applied to the food package, such as prior to singulation or after singulation. During the singulation, the protuberance 70 reduces tacking between the overlapping portions of the tabs 34, 48, thereby resulting in a food package 10 having an easy-open feature that creates a localized gap or spacing between the tabs 34, 48 to facilitate separation of the tabs 34, 48, separation of the lid 40 from the base 20, and thus access to the food compartment 14 of the base 20.

Figure 9:
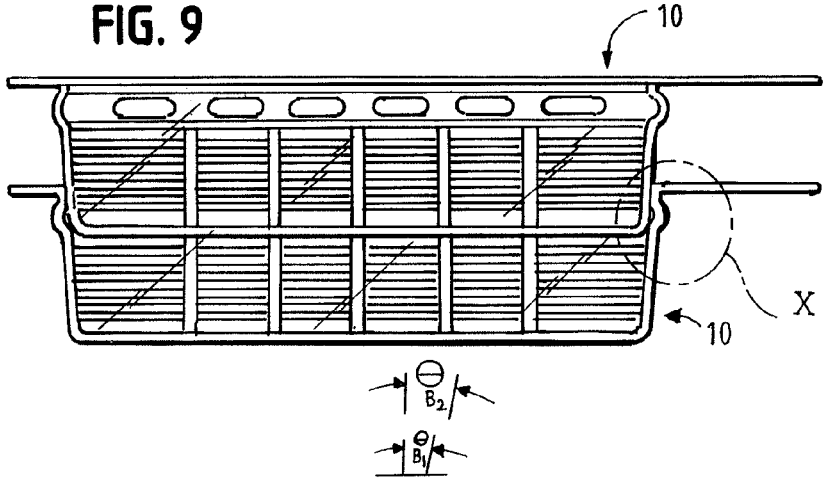
FIG. 9 is a side elevation view of a pair of food packages of FIG. 1 nested together.
Figure 10:
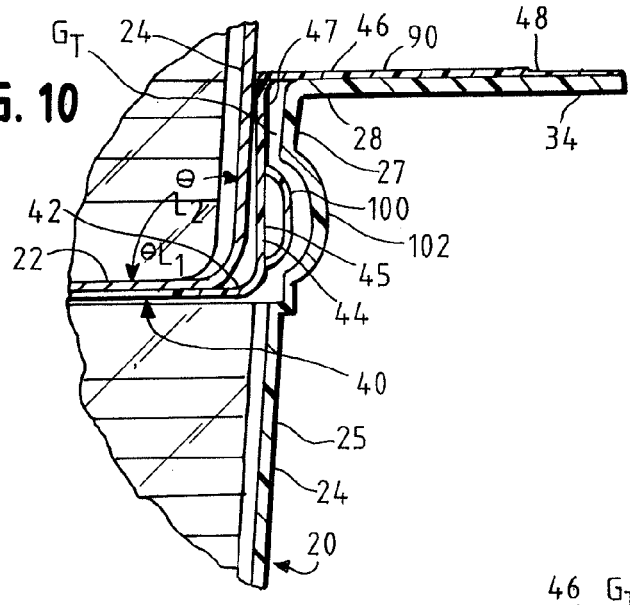
FIG. 10 is a detailed view of the nested food packages of FIG. 9 taken from the circle X.

Turning now to other details of the food packages 10, the food packages 10 are configured to nest when stacked upon each other, as illustrated in FIGS. 9-12. More specifically, the sidewall 24 is sized to partially nest within the recessed food compartment closure 16. In order to facilitate this nesting ability, while still permitting adequate reclosure and interference between the lugs and recesses 100 and 102 of the lid 40 and base 20, the sidewall 24 of the base 20 has multiple angles relative to the bottom wall 22. As illustrated in FIG. 10, the sidewall 24 of the base 20 has a first portion 25 adjacent the bottom wall 22 and a second portion 27 adjacent the flange 28. The first portion 25 has a draft angle $\theta_{B1}$ of between about 93 and 96 degrees relative to the bottom wall 22, as discussed above. The second portion 27 has an angle $\theta_{B2}$ of about 100 degrees relative to the bottom wall 22. The sidewall 44 of the lid 40 also has a first portion 45, adjacent the bottom wall 42, and a second portion 47, adjacent the flange 46. The first portion 45 has an angle $\theta_{L1}$ of about 90 degrees relative to the bottom wall 42, and the second portion 47 has an angle $\theta_{L2}$ of about 100 degrees relative to the bottom wall 42.

When the lid 40 and base 20 of the food package 10 are sealed together at the sealing area 90 and the food package 10 is nested with another food package 10, the angle $\theta_{L2}$ of the second portion 47 of the sidewall 44 of the lid 40 is greater than the angle $\theta_{B1}$ of the adjacent first portion 25 of the sidewall 24 of the base 20 so that there is not interference between the sidewall 24 of the base 20 of the upper food package 10 and the sidewall 44 of the lid 40 of the lower food package 10 when the food packages 10 are nested, as illustrated in FIGS. 9-12. In order to accommodate the second portion 47 of the sidewall 44 of the lid 40, the second portion 27 of the sidewall 24 of the base 20 of the food package 10 to which the lid 40 is sealed has a generally corresponding angle as that of the second portion 47 of the sidewall 44 of the lid 40.

Figure 12:
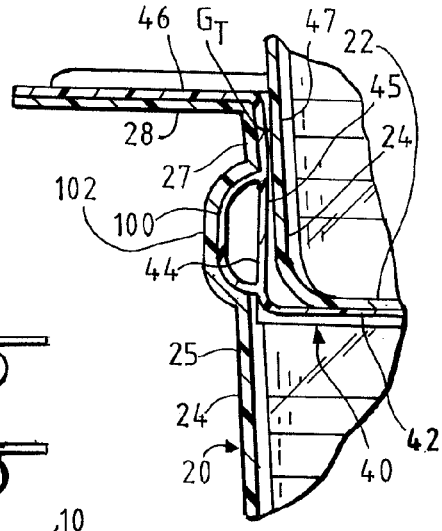
FIG. 12 is a detailed view of the nested food packages of FIG. 11 taken from the circle XII.
Figure 11:
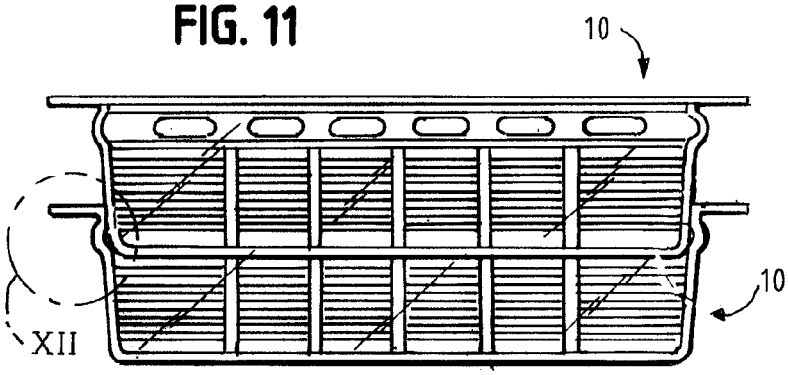
FIG. 11 is a front elevation view of a pair of the nested food packages of FIG. 9.

These corresponding angles of the second portion 47 of the sidewall 44 of the lid 40 and the second portion 27 of the sidewall 24 of the base 20 can be particularly important when the fit between the exterior of the food compartment closure 16 of the lid 40 and the interior surfaces of the food compartment 14 of the base are different between the front and back sides of the food package 10 when compared to the other sides of the food package 10. For example, parallel to the machine direction of manufacture, there may be a greater gap $G_P$ between the second portion 47 of the sidewall 44 of the lid 40 and the second portion 27 of the sidewall 24 of the base 20, as illustrated in FIGS. 9 and 10, as compared to the gap $G_T$ (if any) transverse to the machine direction of manufacture, as illustrated in FIGS. 11 and 12.

The drawings and the foregoing descriptions are not intended to represent the only forms of the easy open food package in regard to the details of construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation.

The invention claimed is:

1. A reclosable food package for storing a food product, the food package comprising:

a base having a bottom wall and an upstanding sidewall extending from the periphery of the bottom wall to form a food compartment between the bottom wall and the sidewall, the base having a peripheral flange extending outward from the sidewall opposite the bottom wall and a tab extending outward from a portion of the peripheral flange;

a lid for covering the food compartment of the base, the lid having a bottom wall and an upstanding sidewall extending from the periphery of the bottom wall, the exterior of the lid sidewall configured to removably engage the interior of the base sidewall to mate the lid and the base and to selectively close the food compartment of the base with the bottom wall of the lid, the lid having a peripheral flange extending outward from the sidewall opposite the bottom wall of the lid, at least a portion of the base and lid flanges surrounding the food compartment overlap and have a sealing area therebetween when the lid closes the food compartment of the base, the lid having a tab extending outward from a portion of the peripheral flange, and at least a portion of the base and lid tabs overlap when the lid closes the food compartment of the base, the overlapping portions of the base and lid tabs having facing sealant layers;

a protuberance disposed on one of the overlapping portion of the base tab and lid tab and projecting toward the other of the overlapping portion of the base tab and lid tab to abut a generally planar portion of the other of the lid and base tab to maintain a localized space between the two overlapping portions of the tabs and to minimize sealing between the facing sealing layers of the base and lid tabs, the protuberance having a length and a width where the length is substantially greater than the width and the protuberance being located near an edge of the overlapping portion of the one of the base tab and lid tab such that the distance from the protuberance to the closest tab edge is less than a half of the distance from the protuberance to the sealing area.

2. The reclosable food package according to claim 1, further comprising a seal in the sealing area of the overlapping base and lid flanges to provide a substantially hermetic seal of the food compartment when the lid closes the food compartment of the base.

3. The reclosable food package according to claim 1, further comprising a plurality of aligned lugs and recesses located on the sidewalls of the base and the lid, the lugs and recesses engaging to generally secure the lid relative to the base when the lid closes the food compartment of the base.

4. The reclosable food package according to claim 3, further comprising a plurality of ridges formed in the sidewall of the base.

5. The reclosable food package according to claim 3, wherein at least one the base tab and the lid tab has sufficient area to include a product label.

6. The reclosable food package according to claim 1, wherein the reclosable food package is generally rectangular and the protuberance is located adjacent a corner of the one of the base tab and lid tab.

7. The reclosable food package according to claim 6, wherein the one of the base tab and lid tab having the protuberance has an arcuate corner and the protuberance is arcuate in shape and adjacent the arcuate corner.

8. The reclosable food package according to claim 6, wherein the protuberance generally corresponds to the shape of the corner of the one of the base tab and lid tab having the protuberance.

9. The reclosable food package according to claim 1, wherein the base and lid are formed of amorphous polyester.

10. The reclosable food package according to claim 1, wherein:

a first portion of the sidewall of the base having a first angle relative to the bottom wall and adjacent thereto;

a second portion of the sidewall of the base having a second angle relative to the bottom wall and adjacent the flange, the first angle being less than the second angle;

a first portion of the sidewall of the lid having a first angle relative to the bottom wall and adjacent thereto; and a second portion of the sidewall of the lid having a second angle relative to the bottom wall and adjacent the flange, the first angle being less than the second angle.

11. The reclosable food package according to claim 10, wherein the second angle of the second portion of the sidewall of the base generally corresponds to the second angle of the second portion of the sidewall of the lid.

12. The reclosable food package according to claim 6, wherein the width of the protuberance is between 0.05 inches and 0.2 inches and a longitudinal centerline of the protuberance is spaced between 0.05 inches and 0.25 inches from the adjacent corner.

13. The reclosable food package according to claim 6, wherein the width of the protuberance is about 0.10 inches and a longitudinal centerline of the protuberance is spaced about 0.10 inches from the adjacent corner.

14. The reclosable food package according to claim 1, wherein the length of the protuberance is at least four times that of its width and a height of the protuberance is at least 25% of the width.

15. The reclosable food package according to claim 1, wherein the length of the protuberance is at least six times that of its width and a height of the protuberance is at least 25% of the width.

16. The reclosable food package according to claim 1, wherein a height of the protuberance is at least twice that of the thickness of the one of the base tab and lid tab having the protuberance.

17. The reclosable food package according to claim 1, wherein a food product is disposed within the food compartment.

18. A method of packaging a food product in a reclosable package, the method comprising:

forming a base in a first sheet of material, the base having a bottom wall and an upstanding sidewall extending from the periphery of the bottom wall to form a food compartment between the bottom wall and the sidewall, the base having a peripheral flange extending outward from the sidewall opposite the bottom wall and a tab extending outward from a portion of the peripheral flange;

forming a lid for covering the food compartment of the base in a second sheet of material, the lid having a bottom wall and an upstanding sidewall extending from the periphery of the bottom wall, the exterior of the lid sidewall configured to removably engage the interior of the base sidewall to mate the lid and the base and to selectively close the food compartment of the base with the bottom wall of the lid, the lid having a peripheral flange extending outward from the sidewall opposite the bottom wall of the lid, at least a portion of the base and lid flanges surrounding the food compartment overlap and have a sealing area therebetween when the lid closes the food compartment of the base, the lid having a tab extending outward from a portion of the peripheral flange, and at least a portion of the base and lid tabs overlap when the lid closes the food compartment of the base;

forming a protuberance disposed on one of the overlapping portion of the base tab and lid tab and projecting toward the other of the overlapping portion of the base tab and lid tab to maintain a localized space between the two overlapping portions of the tabs, the protuberance having a length and a width where the length is substantially greater than the width and the protuberance being located near an edge of the overlapping portion of the one of the base tab and lid tab such that the distance from the protuberance to the closest tab edge is less than a half of the distance from the protuberance to the sealing area;

inserting a food product into the food compartment of the base;

positioning the first sheet having the base formed therein and the second sheet having the lid formed therein adjacent each other such that the lid closes the food compartment of the base;

sealing the lid and the base together at the sealing area;

cutting the lid and the base together from the first sheet and the second sheet after sealing to singulate the reclosable package from the first sheet and the second sheet.

19. The method of packaging a food product according to claim 18, wherein the forming of the base, the forming of the lid, and the forming of the protuberance each comprise thermoforming.

20. The method of packaging a food product according to claim 18, wherein the first sheet and the second sheet are an amorphous polyester.

21. The method of packaging a food product according to claim 18, further including the step of positioning a sealant layer of the base flange adjacent a sealing layer of the lid flange, the sealing layers extending at least partially in the tabs and the sealing area prior to the step of sealing the lid and the base together at the sealing area.

* * * * *

UNITED STATES PATENT AND TRADEMARK OFFICE

CERTIFICATE OF CORRECTION

PATENT NO. : 7,475,780 B2
APPLICATION NO. : 11/362441
DATED : January 13, 2009
INVENTOR(S) : Bonita M. Hinze and Chad M. Evenson It is certified that error appears in the above-identified patent and that said Letters Patent is hereby corrected as shown below:

In Column 10, line 33, delete "one the" and insert --one of the--.

Signed and Sealed this
Eleventh Day of January, 2011

David J. Kappos

David J. Kappos
*Director of the United States Patent and Trademark Office*